US012221915B2

(12) United States Patent
Graf et al.

(10) Patent No.: US 12,221,915 B2
(45) Date of Patent: Feb. 11, 2025

(54) AIR SUPPLY TO AN INTERNAL COMBUSTION ENGINE AND METHOD AND DEVICE FOR DIAGNOSING AN AIR SUPPLY TO AN INTERNAL COMBUSTION ENGINE

(71) Applicant: Robert Bosch GmbH, Stuttgart (DE)

(72) Inventors: Benedikt Graf, Ludwigsburg (DE); Christian Disch, Wimsheim (DE); Conrad Bubeck, Esslingen (DE); Stefan Bauer, Gerlingen (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 18/536,406

(22) Filed: Dec. 12, 2023

(65) Prior Publication Data

US 2024/0191644 A1 Jun. 13, 2024

(30) Foreign Application Priority Data

Dec. 13, 2022 (DE) ..... 10 2022 213 545.8

(51) Int. Cl.
*F01N 3/30* (2006.01)
*F01N 3/22* (2006.01)
*F01N 11/00* (2006.01)

(52) U.S. Cl.
CPC ..... *F01N 3/30* (2013.01); *F01N 3/22* (2013.01); *F01N 11/007* (2013.01); *F01N 2900/1402* (2013.01)

(58) Field of Classification Search
CPC .... F01N 2240/14; F01N 3/32; F01N 2240/16; F01N 3/2006; F01N 3/30;
(Continued)

(56) References Cited

U.S. PATENT DOCUMENTS

2004/0182079 A1 9/2004 Akao et al.
2015/0211733 A1* 7/2015 Shibuya ..... F23D 11/44 431/350

FOREIGN PATENT DOCUMENTS

DE 19508013 C1 * 3/1996 ..... B01D 53/9495
DE 19539938 A1 4/1997
(Continued)

OTHER PUBLICATIONS

DE-19508013-C1 English Translation (Year: 1996).*

*Primary Examiner* — Anthony Ayala Delgado
(74) *Attorney, Agent, or Firm* — NORTON ROSE FULBRIGHT US LLP; Gerard A. Messina

(57) ABSTRACT

An air supply to an internal combustion engine, which includes at least one cylinder and a heater. A first air duct is provided for supplying air to the at least one cylinder of the internal combustion engine for operating the internal combustion engine and a second air duct is provided for supplying air to a heater for heating an exhaust system of the internal combustion engine. The first and second air ducts are connected by a third air duct to an air filter, for providing filtered ambient air to the internal combustion engine. The first and second air ducts in each case have at least one control element for controlling the amount of air flowing through. The second and third air ducts in each case have a mass flow sensor for measuring a mass of the air flowing through the relevant air duct. Methods and devices for diagnosing the air supply are also described.

14 Claims, 2 Drawing Sheets

(58) Field of Classification Search
CPC .... F01N 2560/025; F01N 9/00; F01N 3/2033; F01N 2260/022; F01N 3/2046; F01N 3/0233; F01N 11/00; F01N 2900/0602; F01N 3/323; F01N 3/306; F01N 2900/1812; F01N 2900/0422; F01N 2390/02; F01N 2900/04
See application file for complete search history.

(56) References Cited

FOREIGN PATENT DOCUMENTS

| | | | |
|---|---|---|---|
| DE | 10344910 | A1 | 5/2004 |
| DE | 112008000132 | T5 | 11/2009 |
| DE | 102009000063 | A1 | 7/2010 |
| DE | 102012200444 | A1 | 7/2013 |
| DE | 112014001011 | T5 | 11/2015 |
| DE | 102020215289 | A1 | 6/2022 |
| EP | 2743470 | A1 | 6/2014 |

* cited by examiner

AIR SUPPLY TO AN INTERNAL COMBUSTION ENGINE AND METHOD AND DEVICE FOR DIAGNOSING AN AIR SUPPLY TO AN INTERNAL COMBUSTION ENGINE

CROSS REFERENCE

The present application claims the benefit under 35 U.S.C. § 119 of German Patent Application No. DE 10 2022 213 545.8 filed on Dec. 13, 2022, which is expressly incorporated herein by reference in its entirety.

FIELD

The present invention is based on an air supply to an internal combustion engine and a method and a device for diagnosing an air supply.

BACKGROUND INFORMATION

German Patent Application No. DE 195 08 013 C1 describes an air supply of an internal combustion engine, in which a 1st air duct and a 2nd air duct are present. Air is supplied through the first air duct to cylinders of the internal combustion engine. Air is supplied through a second air duct to a heater for heating an exhaust system of the internal combustion engine.

SUMMARY

An air supply according to the present invention and a method and device for diagnosing an air supply with features of the present invention may have the advantage that, due to the novel assignment of the air ducts to cylinders and to a heater of the exhaust system of the internal combustion engine, novel and improved possibilities arise for diagnosis during ongoing operation. A mutual plausibility check and checking of the measured signals and thus a diagnosis of the entire air system can thus be carried out. In particular, leakages in the air supply, i.e., undesired ingress of air from the environment of the internal combustion engine into the air supply, can thus be detected very reliably. The safety of the internal combustion engine is thus improved. In addition to the advantages for diagnostic possibilities, the air supply according to the present invention is also characterized in that only one air outlet of the two air paths at the air filter box has to be taken into account. This is a particular advantage if for packaging reasons insufficient installation space for a second air outlet is provided. Since the second air outlet for the burner system does not have to be routed up to the air filter box, it can also be designed so as to be geometrically shorter.

Further advantages and improvements result from the features disclosed herein. According to an example embodiment of the present invention, a diagnostic possibility arises particularly easily if no air is flowing through the first air duct and the mass flows through the third and second air ducts are then compared to one another. The reliability of the mass flow sensors or the tightness of the air ducts can thus be checked. A further diagnosis possibility arises if no air is flowing through the first air duct and the mass flow or a pressure in the second air duct is compared to an expected value. The expected value arises from a control of an air pump and the opening of a valve flap in the second air duct. Furthermore, in such operation, in which an air flow occurs only in the second air duct, a check can be made on the oxygen content in the exhaust gas of the heater. In the event of correct functioning, this should largely correspond to an expected value. During operation in which the control elements of the first and second air ducts are controlled such that there is an air flow in the first and second air ducts, the air flow in the first air duct is ascertained by the measured mass flow of the first air duct being subtracted from the measured mass flow of the third air duct. A plausibility check of the mass flows through the first and second air ducts is then effected by a comparison to expected values. In this way, a simple diagnosis of the mass flow through the first and second air ducts can be carried out, and corresponding conclusions can be drawn about correct or faulty operation. If the control elements of the second air duct prevent an air flow, then in the case of correct operation, the flow through the first air duct is indicated by the flow through the third air duct. This flow can then be compared to expected values which result from the operating data of the cylinders and of the control element in the first air duct. A correct or a faulty operation of the air supply can thus be differentiated.

Exemplary embodiments of the present invention are illustrated in the figures and explained in more detail in the description below.

BRIEF DESCRIPTION OF THE DRAWINGS

FIG. 1 shows an air system in which no air is being supplied to the cylinders of the internal combustion engine and a heater of the exhaust system is switched on.

FIG. 2 shows an air system of an internal combustion engine in which air is being supplied to the cylinders of the internal combustion engine, and a heater for heating the exhaust system of the internal combustion engine is switched on.

FIG. 3 shows an air system of an internal combustion engine in which air is being supplied to the cylinders of the internal combustion engine, and a heater for heating the exhaust system of the internal combustion engine is not switched on.

DETAILED DESCRIPTION OF EXAMPLE EMBODIMENTS

Figure 1:
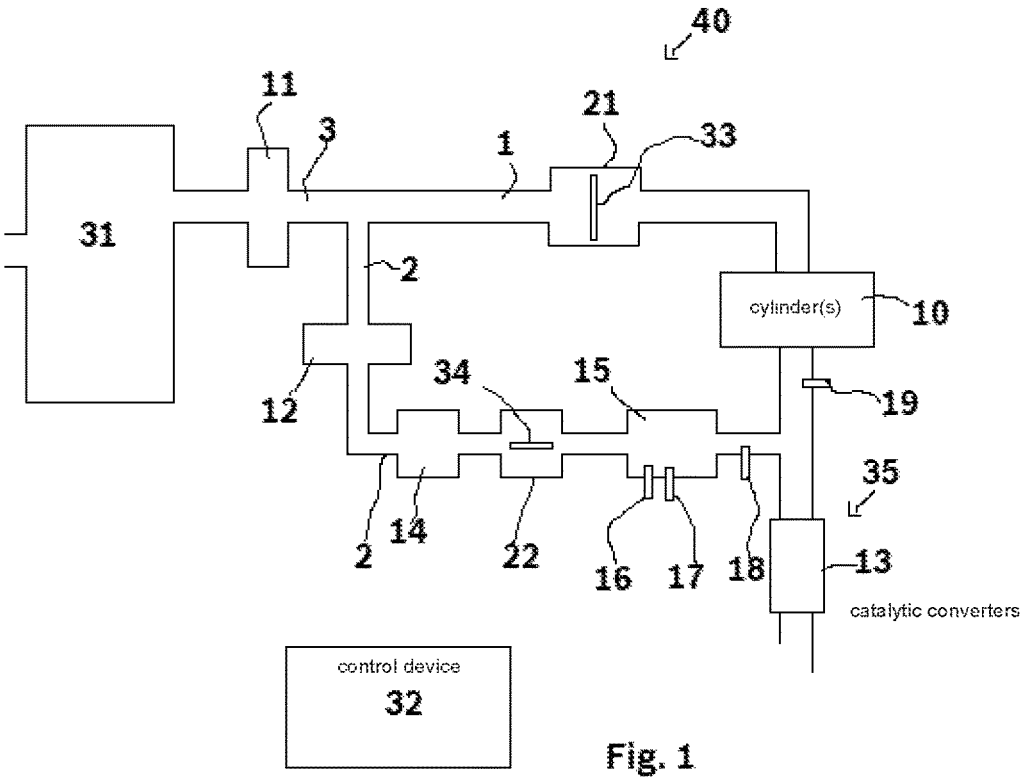

FIG. 1 schematically shows an internal combustion engine 40 with an air supply with a first air duct 1 and a second air duct 2. The air duct 1 is connected to an air filter 31 via a third air duct 3. The air duct 2 is likewise connected to the air filter 31 via the air duct 3. The air filter 31 filters ambient air and provides the filtered ambient air for the operation of the internal combustion engine 40, not only for the cylinders 10 but also for the heater 15.

Starting from the air duct 3, a throttle valve 21 and then at least one cylinder 10 are arranged in the first air duct 1. Starting from the air duct 3, a sensor element 12, an air pump 14, a shut-off valve 22 and then a heater 15 are arranged in the second air duct 2. Alternatively, the sensor element 12 can also be arranged at a different location in the air duct 2 upstream of the heater 15, for example downstream of the air pump 14 or downstream of the shut-off valve 22.

The two sensor elements 11, 12 in each case have a mass flow sensor. The mass flow sensor measures the mass of air that flows through the relevant air duct 1, 3. Furthermore, a pressure sensor and a temperature sensor can also be provided in each case in the sensor element 11, 12. The pressure in the air ducts 1, 3 is measured in each case by pressure sensors. The temperature of the air flowing through the air ducts 1, 3 is measured in each case by the temperature sensors.

The mass which flows through the air duct 1 is controlled by the throttle valve 21. For this purpose, a valve flap 33 is actuated in such a way that it controls the air flow. FIG. 1 shows a position of the valve flap 33 transverse to the air flow, which represents a closed valve flap 33 and thus no flow through the air duct 1. However, the valve flap 33 can also assume intermediate positions between open and closed, by means of which the amount of air that is sucked in by the cylinders 10 of the internal combustion engine is controlled.

The amount of air flowing through the air duct 2 is determined by the air pump 14 and the shut-off valve 22. Only when the air pump 14 is switched on is a negative pressure generated which leads to a flow in the second air duct 2. Furthermore, the amount of air flowing through the air duct 2 can be influenced depending on the position of a valve flap 34 of the shut-off valve 22. The amount of air can be influenced by the delivery rate of the air pump 14 and the position of the valve flap 34. In a particularly simple embodiment, the valve flap 34 can only assume the completely open position or the completely closed position, and the air quantity is controlled only by the delivery rate or rotational speed of the air pump 14. In the representation in FIG. 1, the valve flap 34 is arranged longitudinally or in a laminar manner relative to the air flow, which corresponds to a fully open shut-off valve 22. In the representation in FIG. 1, an air flow through the air duct 2 toward the heater 15 is thus provided.

The cylinders 10 and the heater 15 are each connected to an exhaust system 35 so that the exhaust gases of the cylinders 10 and of the heater 15 are routed through the exhaust system 35. Catalytic converters 13 and at least one lambda sensor 19 are provided in the exhaust system 35. The catalytic converters 13 may have a plurality of partial catalytic converters, for example a first and a second three-way catalytic converter, a particle filter, and a catalytic converter for NOx reduction. The precise function and arrangement of the partial catalytic converters is not important for understanding the present invention. The residual oxygen content in the exhaust gas of the cylinder 10 is determined by the lambda sensor 19. It can thus be ensured that the total quantity of fuel introduced into the cylinders 10 is in a stoichiometric ratio to the introduced air, since only in such an operating range is good cleaning of the exhaust gas ensured.

The heater 15 comprises a fuel injector 16 and an igniter 17. The fuel injector 16 is designed as a conventional fuel injection valve and allows a precisely defined quantity of fuel to be introduced into the heater 15 for a heating operation. The igniter 17 is typically designed as a spark plug or as a glow plug for igniting a fuel/air mixture. A further lambda sensor 18 can optionally also be arranged in the connecting pipe between the heater 15 and the exhaust system 35, by means of which further lambda sensor it can be ensured that the quantity ratios of air and fuel in the heater 15 also correspond to a desired setpoint value.

Typically, the heater 15 is switched on before the internal combustion engine 40 is started or during an early operating phase of the internal combustion engine. For example, the start of an internal combustion engine can be delayed and initially only an operation of the heater 15 take place. A heating of the exhaust system 35 is thus already achieved before the start of an internal combustion engine. As a result of this measure, cleaning of the exhaust gas is already allowed in early operation of the internal combustion engine, since it is not necessary to wait until the exhaust gases of the cylinders 10 reach the operating temperature of the catalytic converters 13 for converting the exhaust gases in the exhaust system 35. A start of the internal combustion engine is therefore delayed for a short time (for example 1 to 10 seconds) in order to ensure a minimum temperature of the exhaust system at start-up of the internal combustion engine. Typically, a second operating phase is then carried out in which the internal combustion engine is already being operated by combustion processes in the cylinders 10 and, at the same time, heating by the heater 15 is also taking place. A further rapid heating of the exhaust system 35 up to an optimal operating temperature of the catalytic converters 13 is thereby ensured. In a third continuous operation of the combustion in the cylinders 10, it is possible for the heater 15 then not to be operated further. If operating phases occur with insufficient heat introduction into the exhaust system 35 during further operation of the internal combustion engine, the heater 15 can be activated again.

For controlling and diagnosing the device according to FIG. 1, a control device 32 is provided which (via lines not shown here) receives signals from all sensors and sends signals for controlling all control elements. The control device 32 processes the sensor signals and calculates control signals for the control element. Accordingly, the diagnostic functions described below are executed by the control device 32. The control device 32 can also be a part of a large control device which can be a wide variety of control tasks for the operation of the internal combustion engine or of a vehicle in which the internal combustion engine is installed.

In FIG. 1, the throttle valve 21 is closed and the air pump 14 is activated, and the shut-off valve 22 is open. FIG. 1 thus shows an operating state in which the cylinders 10 of the internal combustion engine are not in operation and thus no air is flowing through the air duct 1 to the cylinders 10. In contrast, the shut-off valve 22 is open and the air pump 14 is activated. This operating state thus corresponds to a heating of the exhaust system 35 with no combustion taking place in the cylinders 10. This is the case, for example, in an upstream heating operation of the exhaust system 35 before the internal combustion engine is started, for example during a cold start.

Since no air is flowing through the air duct 1, in the case of correct operation, the mass flow through the sensor element 11 corresponds to the mass flow through the sensor element 12. A first simple diagnosis therefore compares the mass flows through air duct 3 and air duct 2, which must necessarily be the same. Since the mass of the air flowing past is always measured by a mass flow sensor, a possibly reduced cross-section of the air duct 2 does not play a role and does not have to be taken into account when considering the mass flows. Alternatively, pressure signals of the sensor elements 11 and 12 can also be evaluated if such pressure sensors are arranged in the sensor elements. However, in such a consideration, the differences in the pressure resulting from a changed cross-section of the air ducts 2, 3 must be taken into account.

Furthermore, it can be taken into account that the mass flow sensors can in each case be adapted for the typical mass flows. The very much smaller mass flow, which typically flows through the air duct 2, can accordingly be taken into account in the design of the air mass sensor 12, such that a measurement error for such mass flow is kept particularly low. In contrast, the mass flow sensor in the sensor element 11 can be optimized for precisely measuring a large mass flow for a full-load operation of the cylinders, while its measurement accuracy can be worse for small flows. Corresponding to the design of the mass flow sensors in the sensor elements 11, 12, it should accordingly also be designed for the tolerance ranges that are used when comparing the sensor signals of the mass flow sensors 11, 12.

The operation of the internal combustion engine 40, as shown in FIG. 1, also makes possible a further diagnosis, particularly of the second air duct 2. For this purpose, the mass flow through the air duct 2 is compared to an expected value which arises from the control of the air pump 14 and, if applicable, the opening of the valve 22 or the position of the valve flap 34. If the flow through the air duct 2 is controlled not only by the operating data of the air pump 14 but also by the position of the valve flap 34, both values will have to be taken into account for the formation of an expected value. If the flow through the air duct 2 is defined only by the operating data of the air pump 14, in particular a delivery rate or rotational speed, then only the operating data of the air pump will have to be taken into account for the formation of an expected value. If it is then determined that the mass flow through the air duct 2 does not correspond to the expected value or the deviation from the expected value is too large, a fault in the air duct 2 will be detected. Such a fault can be, for example, a leak of the air duct 2 toward the ambient air, a fault in the pump 14 or a malfunction in the valve 22. If a pressure sensor is also provided in the sensor element 12, a pressure signal can alternatively also be used for this diagnosis.

The operation of the internal combustion engine 40, as shown in FIG. 1, also makes possible a further diagnosis using the lambda sensor 18 or the lambda sensor 19. During operation according to FIG. 1, in which only the heater 15 is being operated, a disturbance of the ratio of air and fuel in the heater 15 would have a direct effect on the oxygen content of the exhaust gas of the heater 15. The aim is an operation in which air and fuel are introduced into the heater 15 in a stoichiometric ratio, i.e. the same amount of oxygen is available as is required for the combustion of the introduced fuel. A deviation from this can in particular give an indication of a leak in the air duct 2 or an insufficient amount of fuel that has been injected into the heater 15.

In the same way, deviations from desired sub- and superstoichiometric operating phases can also be diagnosed.

If a pressure sensor is additionally arranged in one of the mass flow sensors 11 or 12, it will be possible to detect a successful start of heating by the heater 15. Fuel is introduced into the heater 15 via the injection valve 16 and combustion is started by the spark plug 17. The beginning of heat release in the heater 15 results in a pressure wave which propagates through the air duct 2 and the air duct 3 up to the air filter 31. This pressure wave can be detected by a corresponding pressure sensor in the mass flow sensors 11 or 12, and thus makes it possible to check the successful start-up of the heater 15. This can additionally also be detected by a drop in the delivery of the mass flow that is adjusted briefly. A first release of heat in the combustion chamber and thus an increase in the pressure losses (for the throughflow) in the combustion chamber causes this drop, which is then subsequently rapidly compensated for by the regulation of the air pump.

Figure 2:
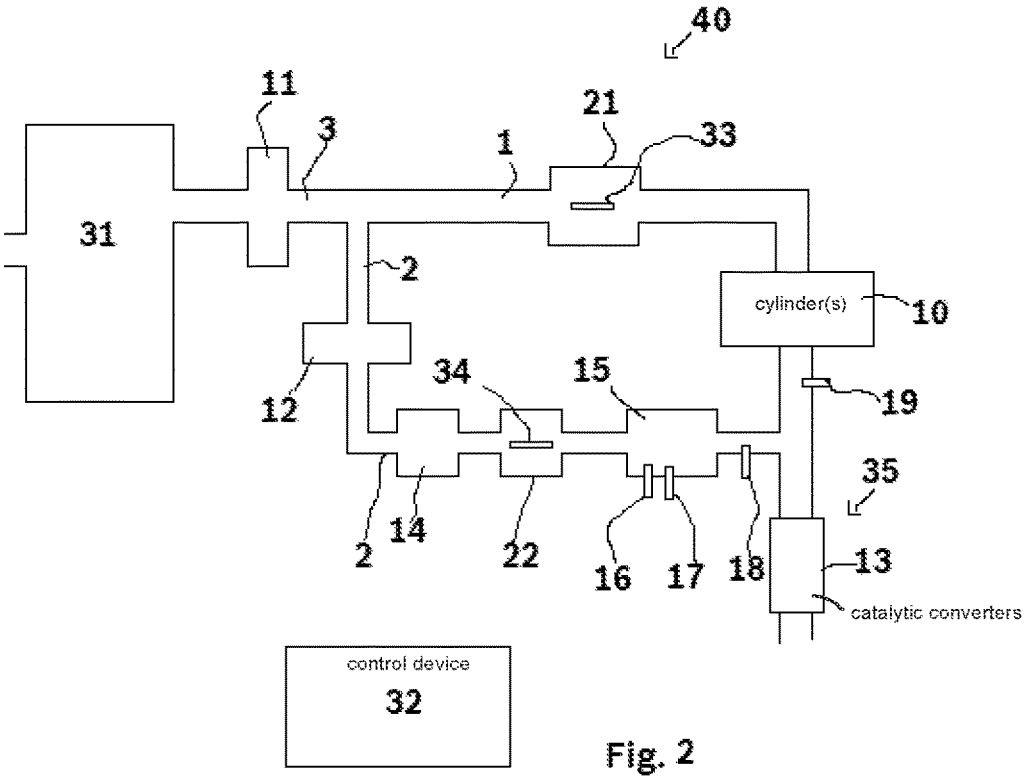

FIG. 2 shows an internal combustion engine 40 with all elements, as has already been described for FIG. 1. In contrast to FIG. 1, however, the valve plate 33 of the throttle valve 21 is shown open and the valve plate 34 of the shut-off valve 22 is also shown open. This is therefore a second operating state of the internal combustion engine 40 in which the cylinders 10 and the heater 15 are simultaneously supplied with air. Such an operating state is useful for achieving a further heating of the exhaust system 35 up to an optimal operating temperature for the catalytic converters 13. After a first heating of the exhaust system 35 to a minimum temperature from which the catalytic converters 13 operate (emissions already converted to parts), a further heating up to the optimal temperature is effected by a simultaneous heating with exhaust gases of the cylinders 10 and of the heater 15. Furthermore, such an operating state can make sense if only a small amount of heat is introduced by the cylinders 10 into the exhaust system 35 during normal operation. This can be the case, for example, in the case of longer overrun phases (for example, driving downhill, no heat release into the exhaust system 35, resulting in rapid cooling) or even in lower partial-load operation (for example, stop-and-go operation, start-stop operation, idling operation) if only small amounts of fuel are introduced into the cylinders 10 and this also results in reduced heat release/exhaust gas temperatures of the heat engine 40.

In this second operating state as well, a diagnosis can also be made by checking the signals of the mass flow sensors 11, 12. For this purpose, the mass flow of air through the air duct 1 to the cylinders 10 must first be ascertained. This takes place by subtracting the measured signal of the mass flow sensor 12 from the measured signal of the mass flow sensor 11. The mass flow sensor 11 measures the mass flow of air that is flowing not only through the air duct 1 but also through the air duct 2. The mass flow of air through the air duct 1 is then compared to an expected value, and in addition the mass flow of air through the air duct 2 is compared to a second expected value. The expected value for the mass flow through the air duct 1 results from the operating parameters of the cylinders 10, for example the rotational speed of the internal combustion engine and load, and from the control of the throttle valve 21, for example the position of the valve plate 33 in the throttle valve 21. The expected value for the mass flow through the air duct 2 results from the operating parameters of the air pump 14 and the valve 22. By comparing the expected values to the measured values, possibly measured faults can be assigned to the individual air ducts.

Figure 3:
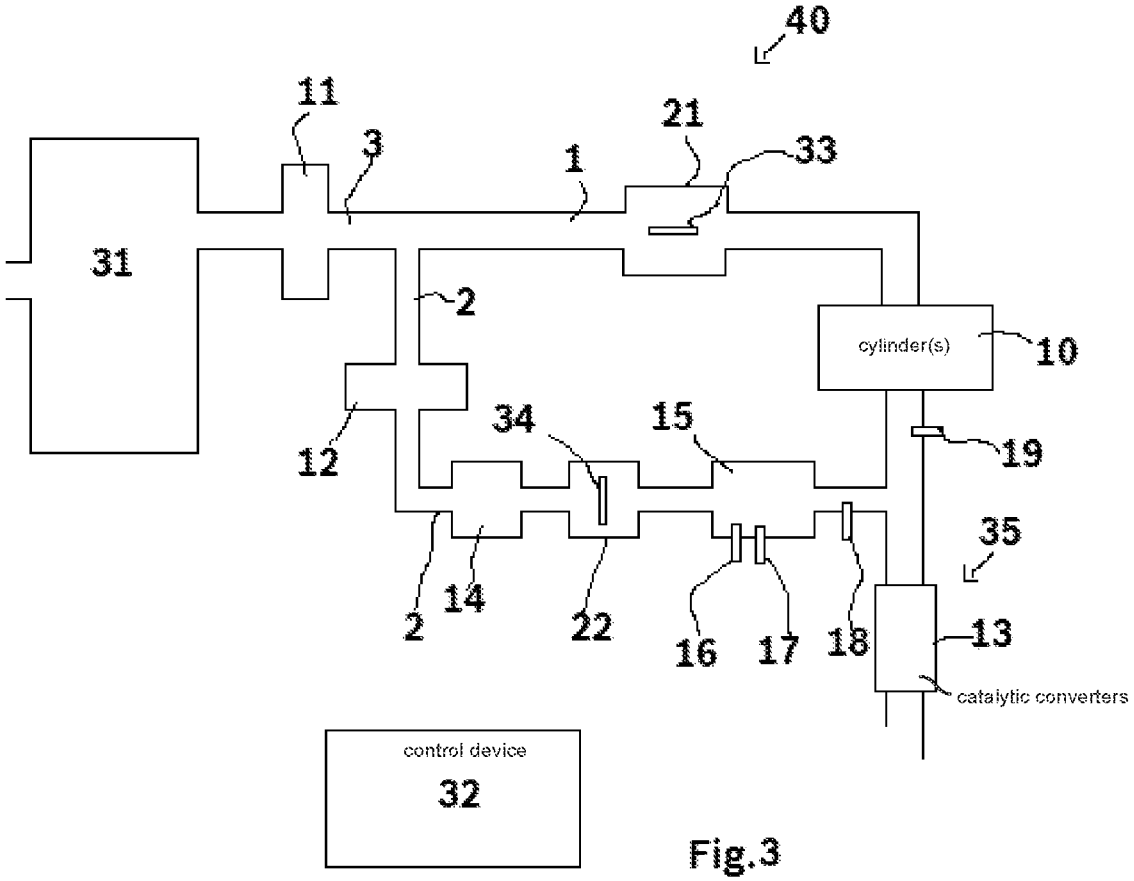

FIG. 3 shows an internal combustion engine 40 with all elements, as has already been described for FIG. 1 or 2. In contrast to FIG. 1, however, the valve plate 33 of the throttle valve 21 is shown open and the valve plate 34 of the shut-off valve 22 is shown closed. This is therefore a third operating state of the internal combustion engine 40 in which the cylinders 10 are supplied with air and the heater 15 is not in operation. This is therefore a normal operation of the internal combustion engine 40, without additional heating provided by the heater 15. Since during fault-free operation there is no air flowing through the air duct 2, the mass flow sensor 11 measures the air flow which is supplied to the cylinders 10 for combustion. A simple diagnosis can thus take place in that this measurement signal of the air mass sensor 11 is compared to an expected value which results from the operating data of the cylinders 10, in particular rotational speed or load, and from the operating data of the throttle valve 21, in particular the position of the valve plate 33.

A further diagnosis can also take place by evaluating a signal of the mass flow sensor 12. The mass flow island 12 must in a trivial manner indicate that there is no air flow in the air duct 2. In this third operating state, a non-zero measurement signal of the mass flow sensor 12 thus makes possible a diagnosis to the effect that a potential leak in the air duct 2 is detected.

Example embodiments of the present invention are also described in the numbered paragraphs below.

Paragraph 1. Air supply to an internal combustion engine (40) which has at least one cylinder (10) and a heater (15) of an exhaust system (35), comprising a first air duct (1) for supplying air to the at least one cylinder (10) of the internal combustion engine (40) for operating the internal combustion engine (40) and a second air duct (2) for supplying air to a heater (15) for heating an exhaust system (35) of the internal combustion engine (40), characterized in that the first and second air ducts (1, 2) are connected by a third air duct (3) with an air filter, for providing filtered ambient air to the internal combustion engine (40), in that the first and second air ducts (1, 2) in each case have at least one control element (21, 14, 22) for controlling the amount of air flowing through, and in that the second and third air ducts (2, 3) in each case have a mass flow sensor for measuring a mass of the air flowing through the relevant air duct (2, 3).

Paragraph 2. Method for diagnosing an air supply according to Paragraph 1, characterized in that, in a first operating phase of the air supply, the control element (21) in the first air duct (1) is closed so that no air flows through the first air duct (1), in that the control element (14, 22) in the second air duct (2) is controlled such that air for operation of the heater (15) flows through the second air duct (2), and in that the mass flows through the third and second air ducts (2, 3) are compared to one another for the diagnosis.

Paragraph 3. Method for diagnosing an air supply according to Paragraph 1, characterized in that, in a first operating phase of the air supply, the control element (21) in the first air duct (1) is closed so that no air flows through the first air duct (1), in that the control element (14, 22) in the second air duct (2) is controlled such that air for operation of the heater flows through the second air duct (2), due to an air pump (14) of the control element being switched on and a valve (22) of the control element being open, and for the diagnosis a mass flow through the second air duct (2) or a pressure signal in the second air duct (2) is compared to an expected value which results from the control of the air pump (14) and the opening of the valve (22).

Paragraph 4. Method for diagnosing an air supply according to Paragraph 1, characterized in that, in a first operating phase of the air supply, the control element (21) in the first air duct (1) is closed so that no air flows through the first air duct (1), in that the control element (14, 22) in the second air duct (2) is controlled such that air for operation of the heater flows through the second air duct (2), due to an air pump (14) of the control element being switched on and a valve (22) of the control element being open, and in that for the diagnosis an oxygen content in the exhaust gas of the heater is measured downstream of the heater and is compared to an expected value.

Paragraph 5. Method for diagnosing an air supply according to paragraph 1, characterized in that, in a second operating phase of the air supply, the control element (21) in the first air duct (1) is open so that air flows through the first air duct (1) to the at least one cylinder (10), in that the control element (14, 22) in the second air duct (2) is controlled such that air for operation of the heater flows through the second air duct (2), due to an air pump (14) of the control element being switched on and a valve (22) of the control element being open, in that the mass flow through the second air duct (2) is subtracted from the mass flow through the third air duct (3) in order to ascertain the mass flow through the first air duct (1) and in that for the diagnosis the mass flows through the first and second air ducts (2) are compared to expected values ascertained from operating data of the cylinders (10) and the control elements in the first and second air ducts (1, 2).

Paragraph 6. Method for diagnosing an air supply according to Paragraph 1, characterized in that, in a third operating phase of the air supply, the control element (21) in the first air duct (1) is open so that air flows through the first air duct (1) to the at least one cylinder (10), in that the control element (14, 22) in the second air duct (2) is controlled such that no air for operating the heater flows through the second air duct (2), due to an air pump of the control element being switched off and a valve (22) of the control element being closed, in that the mass flow through the third air duct (3) is regarded as the mass flow through the first air duct (1), and in that for the diagnosis the mass flow through the first air duct (1) is compared to an expected value which results from operating data of the cylinders (10) and of the actuating element in the first air duct (1).

Paragraph 7. Device for diagnosing an air supply according to Paragraph 1, characterized in that, in a first operating phase of the air supply, the control element (21) in the first air duct (1) is closed so that no air flows through the first air duct (1), in that the control element (14, 22) in the second air duct (2) is controlled such that air for operation of the heater flows through the second air duct (2), and in that means are provided which, in this first operating phase, compare the mass flows through the third and second air ducts (1, 2) to one another for the diagnosis.

Paragraph 8. Device for diagnosing an air supply according to Paragraph 1, characterized in that, in a first operating phase of the air supply, the control element (21) in the first air duct (1) is closed so that no air flows through the first air duct (1), in that the control element (14, 22) in the second air duct (2) is controlled such that air for the operation of the heater flows through the second air duct (2), due to an air pump (14) of the control element being switched on and a valve (22) of the control element being open, and in that means are provided which, in this first operating phase for the diagnosis, compare a mass flow through the second air duct (2) or a pressure signal in the second air duct (2) to an expected value which results from the control of the air pump and the opening of the valve (22).

Paragraph 9. Device for diagnosing an air supply according to Paragraph 1, characterized in that, in a first operating phase of the air supply, the control element (21) in the first air duct (1) is closed so that no air flows through the first air duct (1), in that the control element (14, 22) in the second air duct (2) is controlled such that air for operation of the heater flows through the second air duct (2), due to an air pump (14) of the control element being switched on and a valve (22) of the control element being open, and in that means are provided which measure an oxygen content in the exhaust gas of the heater in this first operating phase downstream of the heater and compare it to an expected value for the diagnosis.

Paragraph 10. Device for diagnosing an air supply according to Paragraph 1, characterized in that, in a second operating phase of the air supply, the control element (21) in the first air duct (1) is open so that air flows through the first air duct (1) to the at least one cylinder (10), in that the control element (14, 22) in the second air duct (2) is controlled such that air for the operation of the heater flows through the second air duct (2), due to an air pump of the control element being switched on and a valve (22) of the control element being open, in that the mass flow through the second air duct (2) is subtracted from the mass flow through the third air duct (3) in order to ascertain the mass flow through the first air duct (1) and in that means are provided which, in this second operating phase, compare the mass flows through the first and second air ducts (2) to expected values ascertained from operating data of the cylinders (10) and the control elements in the first and second air ducts (1, 2).

Paragraph 11. Device for diagnosing an air supply according to Paragraph 1, characterized in that, in a third operating phase of the air supply, the control element (21) in the first air duct (1) is opened so that air flows through the first air duct (1) to the at least one cylinder (10), in that the control element (14, 22) in the second air duct (2) is controlled such that no air for the operation of the heater flows through the second air duct (2), due to an air pump (14) of the control element being switched off and a valve (22) of the control element being closed, in that the mass flow through the third air duct (3) is regarded as the mass flow through the first air duct (1), and in that means are provided which, in this third operating phase, compare the mass flow through the first air duct (1) to an expected value which results from operating data of the cylinders (10) and of the actuating element in the first air duct (1).

What is claimed is:

1. A method for an air supply, the air supply including (a) a first air duct configured to supply air to at least one cylinder of an internal combustion engine for operating the internal combustion engine, (b) a second air duct configured to supply air to a heater for heating an exhaust system of the internal combustion engine, and (c) a third air duct by which the first and second air ducts are connected to an air filter for providing filtered ambient air to the internal combustion engine, wherein each air duct of the first and second air ducts has at least one control element configured to control an amount of air flowing through the respective air duct, and each air duct of the second and third air ducts has a mass flow sensor configured to measure a mass of air flowing through the air duct, the method comprising, in an operating phase of the air supply:

closing the control element in the first air duct so that no air flows through the first air duct;

controlling the control element in the second air duct such that air for operation of the heater flows through the second air duct; and diagnosing the air supply;

wherein the method includes at least one of the following two features (I)-(II):

(I) the diagnosing is performed by comparing mass flows through the second and third air ducts to each other; and (II) the control includes switching on an air pump of the control element in the second air duct and opening a valve of the control element in the second air duct, and the diagnosing is performed by one of:

(i) comparing the mass flow through the second air duct or a pressure signal of the second air duct to an expected value that results from the control of the air pump and the opening of the valve; and (ii) measuring an oxygen content in exhaust gas of the heater downstream of the heater, and comparing the measured oxygen content to an expected value.

2. The method according to claim 1, wherein the diagnosing is performed by the comparing of the mass flows through the third and second air ducts to each other.

3. The method according to claim 1, wherein:

the control includes the switching on of the air pump of the control element in the second air duct and the opening of the valve of the control element in the second air duct; and the diagnosing is performed by comparing the mass flow through the second air duct or the pressure signal of the second air duct to the expected value that results from the control of the air pump and the opening of the valve.

4. The method according to claim 1, wherein:

the control includes the switching on of the air pump of the control element in the second air duct and the opening of the valve of the control element in the second air duct; and the diagnosing is performed by measuring the oxygen content in the exhaust gas of the heater downstream of the heater, and comparing the measured oxygen content to the expected value.

5. A device for an air supply, the air supply including (a) a first air duct configured to supply air to at least one cylinder of an internal combustion engine for operating the internal combustion engine, (b) a second air duct configured to supply air to a heater for heating an exhaust system of the internal combustion engine, and (c) a third air duct by which the first and second air ducts are connected to an air filter for providing filtered ambient air to the internal combustion engine, wherein each air duct of the first and second air ducts has at least one control element configured to control an amount of air flowing through the respective air duct, and each air duct of the second and third air ducts has a mass flow sensor configured to measure a mass of air flowing through the air duct, the device comprising:

a controller, wherein:

in an operating phase of the air supply, the controller is configured to:

close the control element in the first air duct so that no air flows through the first air duct;

control the control element in the second air duct such that air for operation of the heater flows through the second air duct; and diagnose the air supply; and the device includes at least one of the following two features (I)-(II):

(I) the diagnoses is performed by comparing mass flows through the second and third air ducts to each other; and (II) the control includes switching on an air pump of the control element in the second air duct and opening a valve of the control element in the second air duct, and the diagnoses is performed by one of:

(i) comparing the mass flow through the second air duct or a pressure signal of the second air duct to an expected value that results from the control of the air pump and the opening of the valve; and (ii) measuring an oxygen content in exhaust gas of the heater downstream of the heater, and comparing the measured oxygen content to an expected value.

6. The device according to claim 5, wherein the diagnosis is performed by the comparison of the mass flows through the third and second air ducts to each other.

7. The device according to claim 5, wherein the control includes the switching on of the air pump of the control element in the second air duct and the opening of the valve of the control element in the second air duct, and the diagnosis is performed by the comparison of the mass flow through the second air duct or the pressure signal of the second air duct to the expected value that results from the control of the air pump and the opening of the valve.

8. The device according to claim 5, wherein the control includes the switching on of the air pump of the control element in the second air duct and the opening of the valve of the control element in the second air duct, and the diagnosis is performed by the measurement of the oxygen content in the exhaust gas of the heater downstream of the heater and the comparison of the measured oxygen content to the expected value.

9. A method for an air supply, the air supply including (a) a first air duct configured to supply air to at least one cylinder of an internal combustion engine for operating the internal combustion engine, (b) a second air duct configured to supply air to a heater for heating an exhaust system of the internal combustion engine, and (c) a third air duct by which the first and second air ducts are connected to an air filter for providing filtered ambient air to the internal combustion engine, wherein each air duct of the first and second air ducts has at least one control element configured to control an amount of air flowing through the respective air duct, and each air duct of the second and third air ducts has a mass flow sensor configured to measure a mass of air flowing through the air duct, the method comprising, in an operating phase of the air supply:

opening the control element in the first air duct so that air flows through the first air duct to the at least one cylinder; and controlling the control element in the second air duct; and diagnosing the air supply;

wherein the method includes at least one of the following two features (I)-(II):

(I) (i) the controlling of the control element in the second air duct includes switching on an air pump of the control element in the second air duct and opening a valve of the control element in the second air duct, such that air for operating the heater flows through the second air duct, (ii) the method further comprises ascertaining a mass flow through the first air duct by subtracting a mass flow through the second air duct from a mass flow through the third air duct, and (iii) the diagnosing is performed by comparing the mass flows through the first and second air ducts to expected values ascertained from operating data of the cylinders and the control elements in the first and second air ducts; and (II) (i) the controlling of the control element in the second air duct includes switching off the air pump of the control element in the second air duct and closing the valve of the control element in the second air duct, such that no air for operating the heater flows through the second air duct, and (ii) the diagnosing is performed by comparing the mass flow through the first air duct to an expected value that results from operating data of the cylinders and of the control element in the first air duct, with the mass flow through the third air duct being regarded as the mass flow through the first air duct.

10. The method according to claim 9, wherein:

the controlling of the control element in the second air duct includes the switching on of the air pump of the control element in the second air duct and the opening of the valve of the control element in the second air duct, such that the air for operating the heater flows through the second air duct;

the method comprises the ascertaining of the mass flow through the first air duct by the subtracting of the mass flow through the second air duct from the mass flow through the third air duct; and the diagnosing is performed by the comparing of the mass flows through the first and second air ducts to expected values ascertained from the operating data of the cylinders and the control elements in the first and second air ducts.

11. The method according to claim 9, wherein:

the controlling of the control element in the second air duct includes the switching off of the air pump of the control element in the second air duct and the closing of the valve of the control element in the second air duct, such that no air for operating the heater flows through the second air duct;

the diagnosing is performed by the comparing of the mass flow through the first air duct to the expected value that results from the operating data of the cylinders and of the control element in the first air duct, with the mass flow through the third air duct being regarded as the mass flow through the first air duct.

12. A device for an air supply, the air supply including (a) a first air duct configured to supply air to at least one cylinder of an internal combustion engine for operating the internal combustion engine, (b) a second air duct configured to supply air to a heater for heating an exhaust system of the internal combustion engine, and (c) a third air duct by which the first and second air ducts are connected to an air filter for providing filtered ambient air to the internal combustion engine, wherein each air duct of the first and second air ducts has at least one control element configured to control an amount of air flowing through the respective air duct, and each air duct of the second and third air ducts has a mass flow sensor configured to measure a mass of air flowing through the air duct, the device comprising:

a controller, wherein:

in an operating phase of the air supply, the controller is configured to:

open the control element in the first air duct so that air flows through the first air duct to the at least one cylinder; and control the control element in the second air duct; and diagnose the air supply; and the device includes at least one of the following two features (I)-(II):

(I) (i) the control of the control element in the second air duct includes switching on an air pump of the control element in the second air duct and opening of a valve of the control element in the second air duct, such that air for operating the heater flows through the second air duct, (ii) the controller is further configured to ascertain a mass flow through the first air duct by subtracting a mass flow through the second air duct from a mass flow through the third air duct, and (iii) the diagnoses is performed by comparing the mass flows through the first and second air ducts to expected values ascertained from operating data of the cylinders and the control elements in the first and second air ducts; and (II) (i) the control of the control element in the second air duct includes switching off the air pump of the control element in the second air duct and closing the valve of the control element in the second air duct, such that no air for operating the heater flows through the second air duct, and (ii) the diagnoses is performed by comparing the mass flow through the first air duct to an expected value that results from operating data of the cylinders and of the control element in the first air duct, with the mass flow through the third air duct being regarded as the mass flow through the first air duct.

13. The device according to claim 12, wherein:

the control of the control element in the second air duct includes the switching on of the air pump of the control element in the second air duct and the opening of the valve of the control element in the second air duct, such that the air for operating the heater flows through the second air duct;

the controller is configured to ascertain the mass flow through the first air duct by subtracting the mass flow through the second air duct from the mass flow through the third air duct; and the diagnosis is performed by the comparison of the mass flows through the first and second air ducts to expected values ascertained from the operating data of the cylinders and the control elements in the first and second air ducts.

14. The device according to claim 12, wherein:

the control of the control element in the second air duct includes the switching off of the air pump of the control element in the second air duct and the closing of the valve of the control element in the second air duct, such that no air for operating the heater flows through the second air duct;

the diagnosis is performed by the comparison of the mass flow through the first air duct to the expected value that results from operating data of the cylinders and of the control element in the first air duct, with the mass flow through the third air duct being regarded as the mass flow through the first air duct.

* * * * *